US005141076A

United States Patent [19]

Joyce et al.

[11] Patent Number: 5,141,076

[45] Date of Patent: Aug. 25, 1992

[54] STEPLADDER FOOT PAD

[76] Inventors: Randall C. Joyce, 2778 Wagon Wheel Ct., Orlando, Fla. 32822; Eric C. Taylor, 2060 Geronimo Trail, Maitland, Fla. 32751

[21] Appl. No.: 750,934

[22] Filed: Aug. 28, 1991

[51] Int. Cl.[5] ..... E06C 7/46

[52] U.S. Cl. ..... 182/108; 248/188.9

[58] Field of Search ..... 182/108, 107, 109, 110, 182/111; 248/188.9

[56] References Cited

U.S. PATENT DOCUMENTS 1,119,081 12/1914 Hurd ..... 182/108
1,382,833 6/1921 Hurd ..... 182/108
2,507,880 5/1950 Bell ..... 182/108

*Primary Examiner*—Renaldo P. Machado
*Attorney, Agent, or Firm*—Paul S. Rooy

[57] ABSTRACT

A device to be used on the legs of standard wooden folding stepladders to insure the stability of said ladders while being used on weak, non-compacted or slippery areas, into which a stepladder might tend to sink, or across which a stepladder might tend to slide.

Said device consists of a semi-rigid pad that when attached to the bottom of any or all of the legs of any standard wooden folding stepladder will then increase the stepladder leg footprint area resulting in more stability of said stepladder. In addition, the high friction material of which the stepladder foot pad may be constructed will tend to prevent the stepladder legs from slipping across slippery surfaces.

2 Claims, 1 Drawing Sheet

STEPLADDER FOOT PAD

TECHNICAL FIELD

The present invention relates to a device to prevent the legs of standard wooden folding stepladders from sinking into any weak or non-compacted surface areas. In addition said device will prevent standard wooden folding stepladders from sliding across slippery surfaces.

BACKGROUND ART

The concern for safety while using any type of climbing devices has been addressed in many ways. The present invention provides inexpensive protection from falling while using a standard folding wooden stepladder on weak or non-compacted areas (sand, loose dirt, wood chips, small rocks). The research done by this petitioner has failed to discover any prior art that addresses this need.

DISCLOSURE OF INVENTION

Accordingly, it is the object of the present invention to provide a simple, inexpensive device that will quickly slip onto any or all of the legs of standard wooden folding stepladders, thereby enabling said stepladders to remain upright while in use on week or non-compacted surface areas.

The device comprises a circular pad which incorporates the use of an off-center U-shaped three sided perpendicular containment wall. When placed on the bottom of any or all of the legs of standard wooden folding stepladders, this device will increase the leg footprint area.

This increased leg footprint area will tend to prevent the ladder legs from sinking into the surface (sand, dirt, etc.) upon which the ladder rests. The circular pad may be made using a high friction material such as rubber so as to help prevent the ladder legs from slipping across the surface upon which the ladder rests. The stability and safety of use of a stepladder is therefore increased through the stepladder foot pad.

BRIEF DESCRIPTION OF THE DRAWINGS

The object and features of the present invention will become apparent from the following description taken in conjunction with the accompanying drawings in which.

COMPLETE DESCRIPTION OF THE PREFERRED EMBODIMENT

Figure 1:
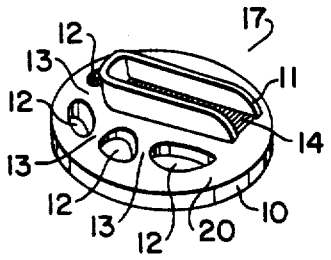
FIG. 1 is a side view of the preferred form of the device constructed with the teachings of the present invention.

Referring now to the drawings; a device (17) in accordance with the teachings of the invention is illustrated. The device (17) consists of a circular pad (20) [FIG. 1] with an off-center U-shaped three sided perpendicular containment wall (11) used to contain the lower legs (15) of a standard folding wooden stepladder (18).

The design of the device (17) as shown in FIG. 1 incorporates a containment wall. (11) Apertures (12) are incorporated in base (20) defining spokes (13). On the floor (14) within the containment wall (11) is a treadlike design that is utilized to aid in preventing said ladder legs (15) from slipping on said floor (14).

Figure 2:
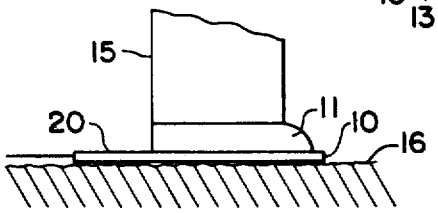
FIG. 2 is a side view of the device with a ladder leg shown in place within the containment area.

FIG. 2 is a side view of the device (17) showing a stepladder leg (15) within said containment wall (11). The surface area (16) upon which the stepladder foot pad rests is also depicted.

Figure 3:
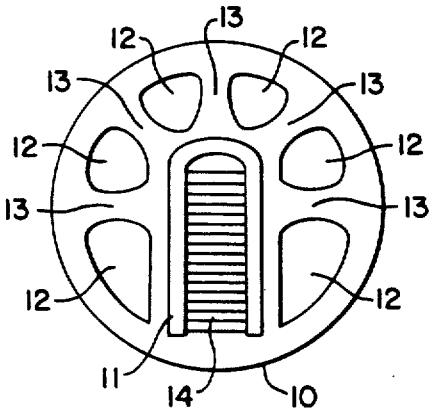
FIG. 3 is a top view of the stepladder foot pad.

FIG. 3 is a top view of the device (17) showing how the design defines a rim (10) which connects via the spokes (13) to the off-center U-shaped three sides perpendicular containment wall (11). FIG. 3 also shows the treadlike design of the floor (14) within the containment wall (11), as well as apertures (12) as they are located on said device.

Figure 4:
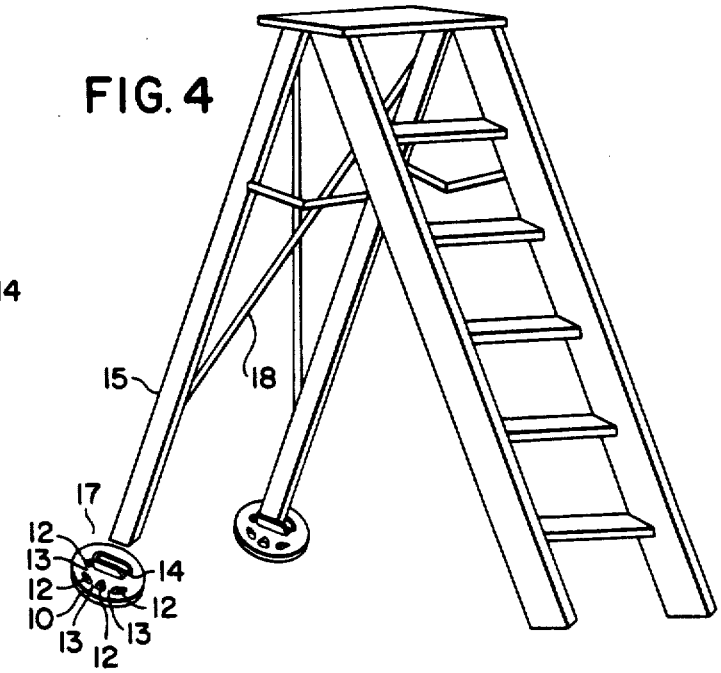
FIG. 4 is a side isometric view showing a stepladder being installed on a pair of stepladder foot pads.

FIG. 4 shows the device (17) as it relates to it's use on an actual wooden folding stepladder (18). The stepladder legs (15) are inserted into the area defined by containment wall (11) such that the stepladder leg bottom surface (19) rests upon floor (14). The treadlike design of floor (14) helps prevent the stepladder leg bottom surface (19) from slipping on floor (14).

The stepladder (18) is then positioned on surface (16) as desired, and the stepladder foot pad (17) helps prevent the legs (15) of stepladder (18) from sinking into surface (16) and also helps prevent stepladder legs (15) from sliding across surface (16), thereby enhancing the stability and safety of use of stepladder (18).

Figure 5:
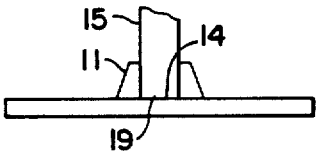
FIG. 5 is a rear view of the device showing a ladder leg within the containment wall.

FIG. 5 is a rear view of the device (17) as it holds a ladder leg (15) securely within the containment wall (11). We can observe the stepladder lower surface (19) resting securely on floor (14). Circumferential rim (10) is also visible.

Although a preferred embodiment is described herein, it is to be understood that modifications and changes made by those skilled in the art are intended to fall within the scope of the claims appended hereto.

We claim:

1. A stepladder foot pad comprising a circular base, a U-shaped containment wall extending upwardly from said base, defining a non-slip floor area into which a stepladder leg may be inserted, said base is comprised of a circumferential rim, apertures formed into said circumferential rim in side by side relation forming spoke like member therebetween, whereby said leg of said ladder is prevented from sinking into any loose or non-compacted surface area upon which said stepladder leg rests.

2. The stepladder foot pad of claim 1, wherein said stepladder foot pad is manufactured of a high friction material such as rubber, thereby helping to prevent said stepladder legs from sliding across the surface upon which said stepladder rests.

* * * * *